US006109359A

United States Patent [19]

Ballard

[11] Patent Number: 6,109,359

[45] Date of Patent: Aug. 29, 2000

[54] COMPRESSED AIR FOAM SYSTEM

[76] Inventor: Paul Corwin Ballard, 926 Meadowlark Dr., Laguna Beach, Calif. 92651

[21] Appl. No.: 09/275,056

[22] Filed: Mar. 23, 1999

[51] Int. Cl.[7] ..... A62C 35/00

[52] U.S. Cl. ..... 169/14; 169/44; 169/5

[58] Field of Search ..... 169/14, 15, 43, 169/44, 13, 5, 51, 52

[56] References Cited

U.S. PATENT DOCUMENTS

| | | | |
|---|---|---|---|
| Re. 36,196 | 4/1999 | Eberhardt | 169/14 |
| 1,319,101 | 10/1919 | Meigs | 169/14 |
| 1,403,621 | 1/1922 | Patterson | 169/14 |
| 1,655,722 | 1/1928 | Bedford | 169/14 |
| 3,234,962 | 2/1966 | Williamson . | |
| 4,278,132 | 7/1981 | Hostetter | 169/15 |
| 4,520,871 | 6/1985 | Miller et al. | 169/43 |
| 5,348,099 | 9/1994 | Yokoi | 169/51 |
| 5,411,100 | 5/1995 | Laskaris et al. | 169/14 |
| 5,494,112 | 2/1996 | Arvidson et al. | 169/14 |
| 5,738,174 | 4/1998 | Sundholm . | |
| 5,799,735 | 9/1998 | Sundholm | 169/14 |
| 5,803,596 | 9/1998 | Stephens | 169/15 |
| 5,881,817 | 3/1999 | Mahrt | 169/15 |
| 5,979,563 | 11/1999 | Fritz . | |
| 6,006,840 | 12/1999 | Sundholm | 169/14 |

*Primary Examiner*—Andres Kashnikow
*Assistant Examiner*—Christopher S. Kim
*Attorney, Agent, or Firm*—Levin & Hawes; Owen Bates; Dennis W. Beech

[57] ABSTRACT

The present invention relates to an apparatus which permits a user to operate a compressed-air foam generating apparatus by activating a single valve which initiates all necessary pressures and flows to create and discharge a flow of compressed-air foam. By use of a master valve to control gas pressure from a gas pressure source and by routing of this gas for pumping and mixing operations, the user opens the master valve to initiate apparatus operation producing compressed-air foam flow and dispensing through a dispensing hose.

11 Claims, 6 Drawing Sheets

COMPRESSED AIR FOAM SYSTEM

FIELD OF THE INVENTION

The present invention relates to an easily operated system for the generation of foam, typically used in suppression and pre-suppression fire fighting situations.

BACKGROUND

There have been a number of techniques which have been developed over the years which have been used to fight fires. Dirt and water have been used for thousands of years as a means to smother fires. More recently, water dispensing systems, including fixed, mobile and portable systems have been developed to facilitate the extinguishing and prevention of fires.

Water alone, though effective, has significant drawbacks, which include weight, availability, resulting damage to property, and failure to adhere to vertical structures. Any reasonable amount of water, which weigh about 8 pounds per gallon, is extremely heavy and either has to be stored on site, made accessible via plumbing systems whose pumps must stay operational during a fire, or transported to the site. Each of these solutions has significant drawbacks.

As a means to address these shortcomings, systems have been developed which use a foaming agent in conjunction with water to create a foam which can be sprayed directly on the material, whether burning or not.

Foams designed to protect material from burning are called pre-suppression foams and use one type of foaming agent. Foams designed to be used on burning material are called suppressant foams and use a separate type of foaming agent.

Foaming techniques are divided into two general classes. These are aspirated foam systems or compressed air foam systems also known as CAFS.

Aspirated foam systems do not use compressed gases to create the foam. A mixture of foam concentrate and water is pumped through a special aspirating nozzle located at the end of the delivery hose. This special nozzle is designed to draw in atmospheric air and mix it with the foam concentrate-water mix to create foam. Because aspirated foam systems are not powered by compressed gases, they do not project the foam a great distance from the end of the nozzle and are meant primarily for laying firebreaks along the ground and down hillsides. Thus aspirated foam systems are often refered to as low energy systems.

Compressed air foam systems operate by a different method. Compressed gas, usually air, is introduced into the foam concentrate-water mixture at high pressure, usually in the range of 60–100 psi. The air is mixed with the foam concentrate-water mixture either with an active mixing device or a passive mixing device which can be as simple as a long length of fire hose. Once the foam, which is now under high pressure, exits the delivery hose, it can travel for quite a distance, usually as much as 70 to 100 feet. Thus compressed air foam systems are referred to as high energy systems. This feature enables the user to direct the foam to hard-to-reach distant locations and keeps the user at a safe distance from the fire.

As discussed above, both the aspirated and CAFS create the foam from a foam concentrate-water mixture. There are several ways in which the mixture can be made.

One method is to simply mix the two components together in one tank and then draw that mixture into the system. This is an acceptable method in some situations, but some foam concentrates have a limited useful life after the foam concentrate has been mixed with water.

Another method is to use an eductor proportioning system which can be located on the inlet side or outlet side of the pump. In either case, the water that is either being drawn into the pump or delivered out of the pump is directed through a venturi-type device which creates a vacuum on an auxiliary inlet port. This auxiliary inlet port is connected to a tank of the foam concentrate. The actual ratio of the two components depends on the such factors as the size of the various inlet and outlet openings, flow rate of the water, and the size of the interior channels of the eductor.

The compressed gas is generally provided by one of two means. The first is a standard high pressure cylinder or gas tank. The second is a mechanically driven air compressor. The compressor can be driven by an electric motor or a gas engine. Use of such devices can be problematic for several reasons. In fire situations, the electrical supply may not be operating due to downed power lines. Likewise, gas engines may not run because the local environment can become oxygen depleted because of the fire. In addition, the fuel stored in the tanks of the gasoline engines can go bad. Gasoline is not a pure component, but rather a mixture of components of varying volatilities in order to provide good running conditions. As gas ages, the lower molecular weight components evaporate. Because these tend to be the more volatile components, older gas doesn't vaporize as well and an engine using the older gas will be harder to start. Thus gasoline driven compressors require considerable maintenance and upkeep in order to be a reliable source of compressed gas.

Another solution is to provide a bank of compressed gas cylinders which will supply the compressed gas for the generation of the foam. The pump can also be designed to be driven by the compressed gas, so that it too is independent of the local electrical supply and/or internal combustion engines.

BRIEF DESCRIPTION OF THE DRAWINGS

Existing compressed air foam systems and several embodiments of the present invention will now be described with reference to the following drawings, in which FIG. 1. is a flow schematic for existing compressed air foam systems.

EXISTING STORED ENERGY COMPRESSED AIR FOAM SYSTEMS

Figure 1:
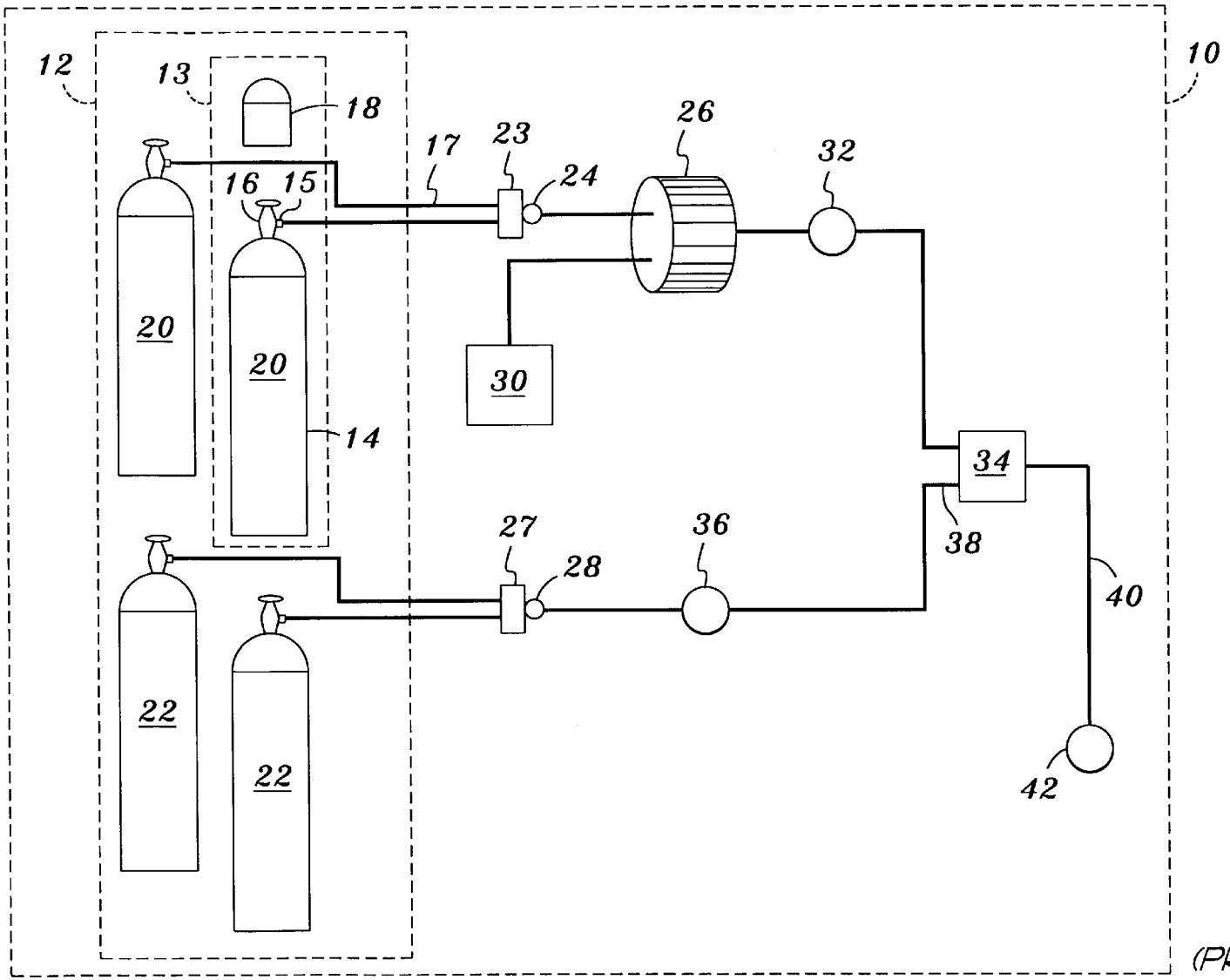
FIG. 1 (PRIOR ART)

The general layout and operation for a typical CAFS is now described. Reference is now made to FIG. 1. Existing CAFS 10 shall be described by first starting with the compressed gas cylinder bank 12. Compressed Gas Cylinder Bank 12 is comprised of two or more Compressed Gas Tanks 13. Each Compressed Gas Tank 13 is comprised of Cylinder Body 14, High Pressure Fitting 15, Cylinder Valve 16, and Cylinder Cap 18. Cylinder Valve 16 is located at the top of Compressed Gas Tank 13, and controls the flow of the compressed gas from Cylinder Body 14. A series of High Pressure Hoses 17, are attached to each High Pressure Fitting 15 and used to convey the high pressure gas to other parts of the Existing CAFS 10. High Pressure Fitting 15 usually incorporates a check valve to prevent accidental lose of stored gas from the Compressed Gas Tank 13. The Cylinder Valve 16 is the weakest structure on the tank. If the Cylinder Valve 16 were to be broken off, the Compressed Gas Tank 13 could take off like a rocket and become a deadly projectile. Because of this significant danger, all compressed gas tanks are fitted with a Cylinder Cap 18.

Normal mode of operation first requires that the Cylinder Cap 18, be removed from all Cylinder Body 14. In order to leave the high pressure hoses attached to the Cylinder Valve 16, the Cylinder Cap 18 has been designed as a two piece clam shell design so that High Pressure Hose 17 can remain attached to the High Pressure Fitting 15, yet still have the Cylinder Cap 18 fit around the Cylinder Valve 16 and provide protection.

After each Cylinder Cap 18 has been opened and removed, each Cylinder Valve 16 is actuated so as to release compressed gas into High Pressure Hose 17. Compressed Gas Cylinder Bank 12 is divided into two sections, Pump Bank 20 and Foam Bank 22. One or more Compressed Gas Tanks 13 can be used to make up each of Pump Bank 20 and Foam Bank 22.

All the Compressed Gas Tanks 13, that comprise Pump Bank 20, are connected to High Pressure Manifold 23 which in turn is connected to Pump Regulator 24, which receives the high pressure gas at about 2500 psi and outputs the gas at a pressure of about 60–125 psi. The reduced pressure output from Pump Regulator 24 is typically directed to the compressed gas inlet of compressed-gas-driven double diaphragm Pump 26.

The fluid intake to Pump 26 is connected to Foam Concentrate/Water Reservoir 30, which typically contains a 1–3% mixture of foam concentrate in water. The outlet of Pump 26 is connected to one port of Ball Valve 32. The second port of Ball Valve 32 is connected to the first inlet of Mixing Chamber 34.

All the Compressed Gas Tanks 13 that comprise Foam Bank 22 are connected to High Pressure Manifold 27 which is in turn connected to Foam Regulator 28, which receives the high pressure gas at about 2500 psi and reduces the pressure to about 60–125 psi. The low pressure outlet of Foam Regulator 28 is connected to the first port of Ball Valve 36. The second port of Ball Valve 36 is connected to Gas Inlet 38, which is located a the first end of Mixing Chamber 34. The compressed gas, passing through Ball Valve 36 and Gas Inlet 38 is introduced into the foam concentrate/water mixture that is being delivered by Pump 26. The foam is generated in the Mixing Chamber 34, the outlet port of which is connected to the first end of Hose 40. The second end of Hose 40 is fitted with Outlet Valve 42, which is used to control the actual delivery of foam during use of the invention.

In actual use, which usually occurs during an emergency fire situation, the steps to operate the above typical device are as follows:

1. Add the foam concentrate to water which is stored in a large holding tank. Mix well in order to achieve a homogeneous solution. This step can't be done too far ahead of time, as the mixture is not stable. Typically, the mixture is stable for no more than 24 hours. In addition, the storage containers for the foam concentrate can be heavy and the caps are often very difficult to remove.
2. Remove the clam shell tank caps. There might be as many as 10–12 tanks or more and therefore 10–12 tank caps need to be removed.
3. Open each of the 10–12 tank valves. These valves are often very tight and difficult to open.
4. Replace all 10–12 clam shell tank caps. Though not required for operation, it is a very important safety consideration to keep the valves protected.
5. Adjust the Pump and Foam pressure regulators to the appropriate settings.
6. Unwind the hose out to its full length. If required for additional length, unwind additional sections of hose and connect to each other and to the pump. If you pressurize the hose prior to it being fully extended, it will expand uncontrollably and will likely become tangled and will be difficult to handle.
7. Open the valve controlling the output from the Pump. Open the valve controlling the flow of air into the foam concentrate mixture in the mixing chamber.
8. Open the Outlet valve and dispense foam.
9. Carefully balance the relative flows of foam concentrate/water and air, by adjusting the appropriate valve, so that the ratio between water/foam concentrate and air and the overall flow rate are proper in order to generate foam with the required characteristics.

There are a number of steps, as described above, which need to be taken in an emergency in order for the system to properly generate sufficient quantities of the correct quality foam. For effective operation, the user must have had prior experience with the system and prior experience with adjusting flows in order to get foam of the required characteristics. In an emergency situation, the time taken to implement these steps and the likelihood that some of the steps may not be performed properly, is significant and the results could be tragic.

Preferred Embodiment

Figure 2:
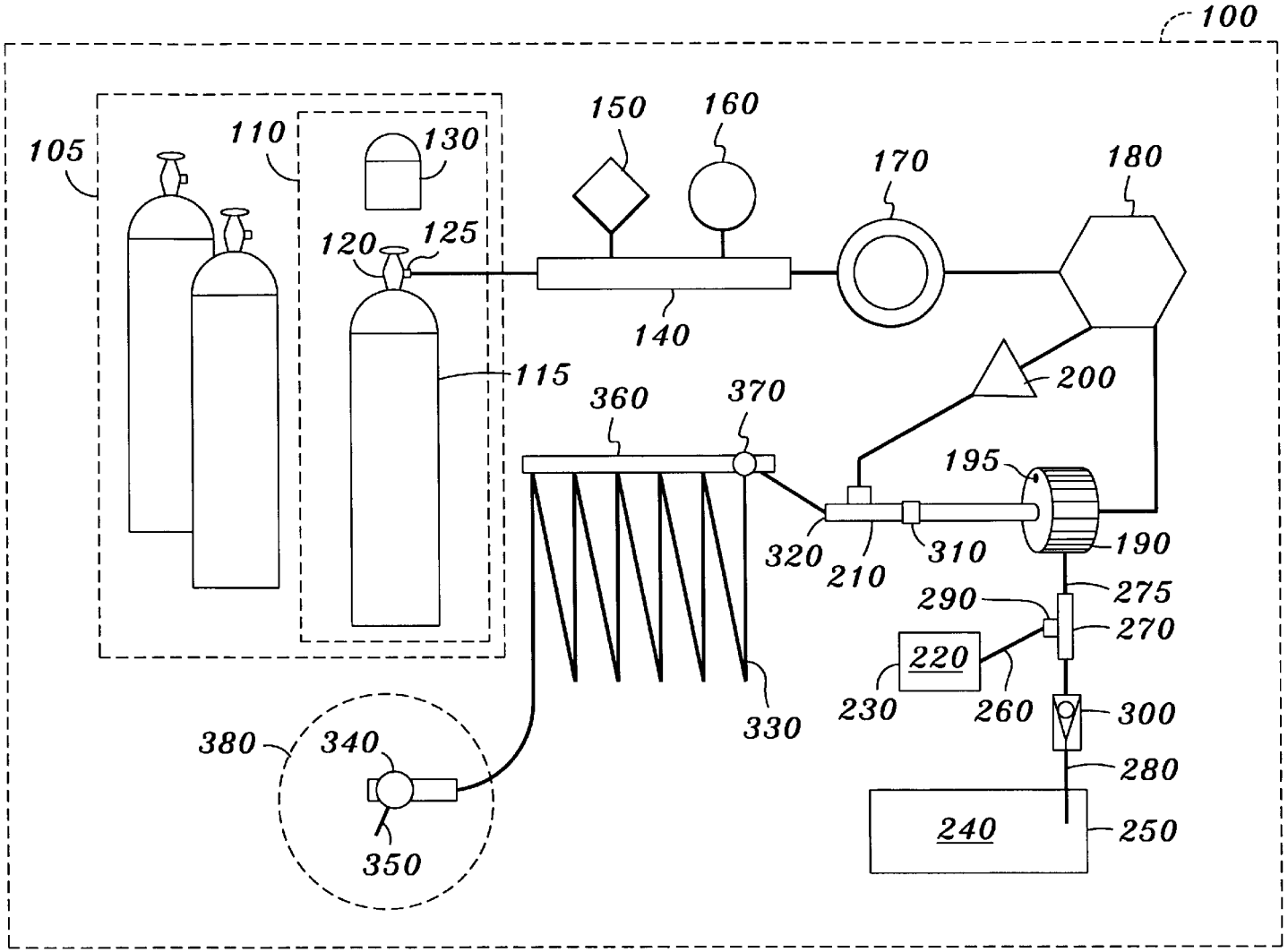
FIG. 2. is a flow schematic for the preferred embodiment for the instant invention.
Figure 2A:
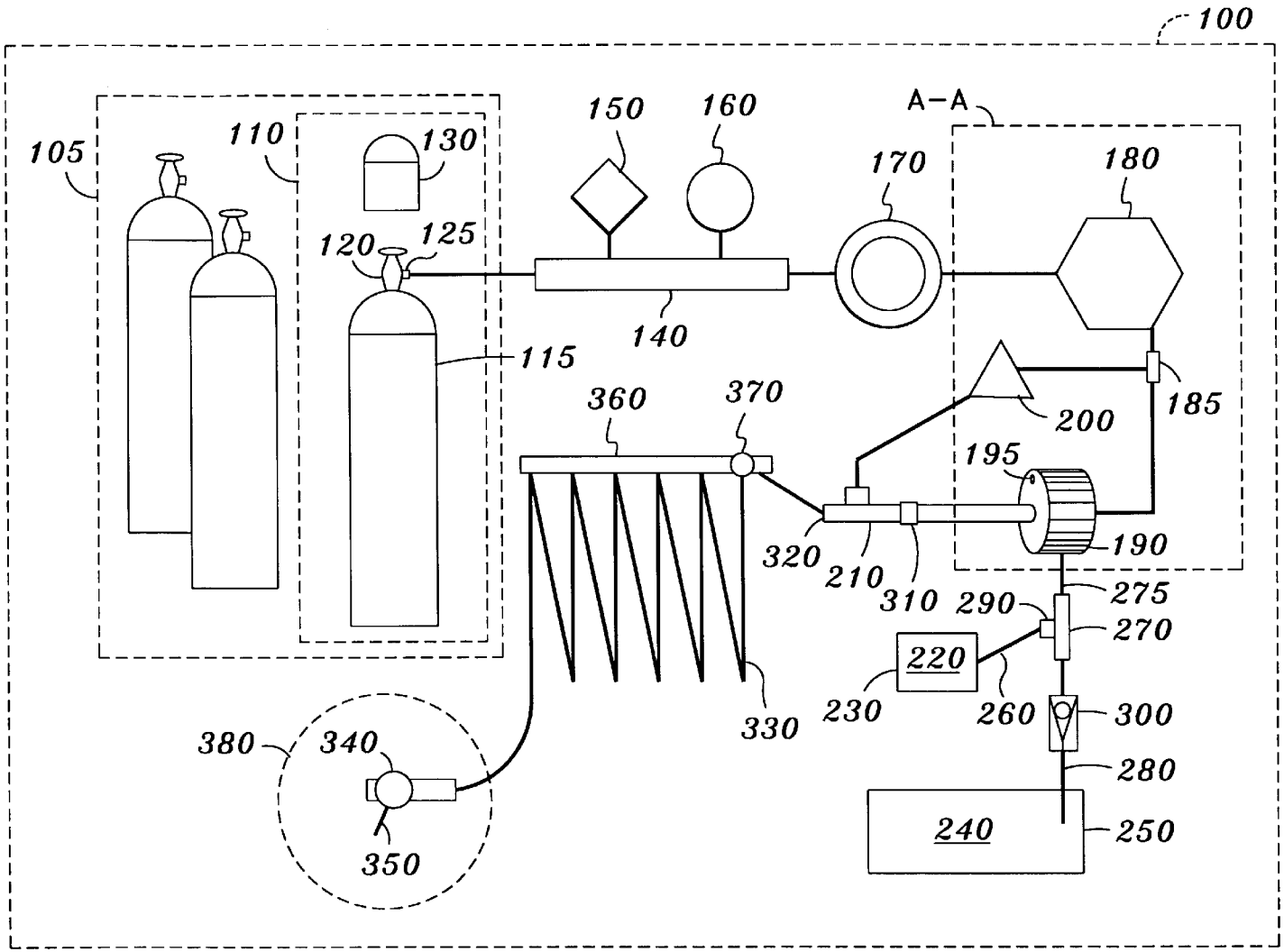
FIG. 2A is a flow schematic for an alternative embodiment as identified at A—A.

The present invention implements a system that utilizes fewer components and requires far fewer steps by the user in order to operate the device. In summary, the system, once installed and configured, can be made operationally ready by turning a single valve. A user does not have to have prior foam making experience in order to effectively use the instant invention. Reference is now made to FIG. 2 during the following description of the preferred embodiment.

The One-Valve CAFS 100 is composed of a Compressed Gas Cylinder Bank 105. Compressed Gas Cylinder Bank 105 is composed of at least one Compressed Gas Tank 110.

Each Compressed Gas Tank 110 is composed of a Cylinder Body 115, a Cylinder Valve 120, a High Pressure Fitting 125 and a Cylinder Cap 130. High Pressure Fitting 125 is preferably a low leakage rated fitting referred to as a "Hand Tight CGA" fitting. Cylinder Cap 130 typically is a standard cap which has been modified in the following manner. There is an access slot in the side of cap to allow the fitting from High Pressure Manifold 140 to be attached to the High Pressure Fitting 125 while Cylinder Cap 130 is screwed onto Cylinder Body 115. High Pressure Manifold 140 is preferably a welded assembly, but a manifold assembled from standard fittings can be used if the leakage rate is acceptable. The slot in Cylinder Cap 130 is aligned with High Pressure Fitting 125 by screwing Cylinder Cap 130 completely onto Cylinder Body 115 and then backing it off just enough so that that slot lines up with High Pressure Fitting 125.

In addition, there is a hole drilled into the top of Cylinder Cap 130 to allow access to the Cylinder Valve 120.

Typically, Cylinder Valve 120 is fitted with a standard round handle which is attached to the actual valve stem which usually has a ⅜" inch square stem extending out from Cylinder Valve 120. With the Cylinder Cap 130 in place on Cylinder Body 115, a special wrench may be inserted through the hole in the top of Cylinder Cap 130 which then engages the square stem and permits the Cylinder Valve 120 to be turned on or off as needed.

High Pressure Manifold 140 connects all the High Pressure Fittings 125 from each Compressed Gas Tank 110 into a common manifold. Part of the High Pressure Manifold 140 is the Auxiliary Port 150 which provides access to the manifold for training, testing and backfilling the Compressed Gas Tanks 110. High Pressure Manifold 140 is also connected to High Pressure Gauge 160. Because each Compressed Gas Tank 110 is opened and kept open, when the One-Valve CAFS 100 is set up, the High Pressure Gauge 160 is used to monitor the pressure in the Compressed Gas Cylinder Bank 105 and the High Pressure Manifold 140. The pressure registered on High Pressure Gauge 160 is an indication of the how much compressed gas is in the Compressed Gas Cylinder Bank 105 and whether the Compressed Gas Tanks 110 are fully charged and that the One Valve CAFS 100 is ready for use.

High Pressure Manifold 140 which is also connected to Master Valve 170. Master Valve 170 is preferably a #900 valve from Sherwood West. When One-Valve CAFS 100 is in its normal state of readiness, each of the Compressed Gas Tanks 110 have the Cylinder Valve 120 opened so that High Pressure Manifold 140 is pressurized to full tank pressure. The pressure in High Pressure Manifold 140 is indicated by High Pressure Gauge 160. In its normal state of readiness, Master Valve 170 is turned off so there is no pressurization of the down-stream portions of One-Valve CAFS 100. When foaming is needed, Master Valve 170 is placed in its fully open position, which pressurizes the rest of the system and enables the system to produce foam. Master Valve 170 is usually a three-turn valve which allows the pressurization of the downstream components to take place over a few seconds as the valve is opened. Master Valve 170 should not be a ¼-turn ball valve or any other valve which causes the downstream components to be pressurized almost instantly. Such instant pressurization could cause damage to various components.

Immediately down stream from Master Valve 170 is the Pressure Regulator 180. Pressure Regulator 180 receives the high pressure gas from the High Pressure Manifold 140 and reduces it to a pressure in the range of 60 to 120 psi. Regulator 180 is preferably a #450-D from Victor Equipment Co.

In the described configuration, Regulator 180 is not pressurized while the system is not operating. Regulators have a number of seals and ports which are sources of leaks. As the One-Valve CAFS 100 is designed to be partially pressurized, it was initially chosen to locate the regulator downstream from Master Valve 170 so as remove the regulator as a source of leaks. The disadvantage is that the regulator is subject to some degree of shock each time the Master Valve is opened and the regulator comes under pressure.

As an alternative design, the locations of Regulator 180 and Master Valve 170 can be swapped, positioning Regulator 180 directly in communication with Manifold 140 and having Master Valve 170 be connected to the outlet of Pressure Regulator 180.

A reduced pressure port on the outlet side of Pressure Regulator 180 is connected to the Pump 190 where the gas pressure is used to drive the Pump 190. Pump 190 is preferably a dual diaphragm, air-driven pump from ARO, model #6660150-361-C. The gas used to operate Pump 190 is expelled to the surrounding environment through Exhaust Port 195. A second reduced pressure outlet port of Pressure Regulator 180 is connected to Flow Regulator 200 which is then connected to a first input port of Mixing Tee 210. As an alternative, Pressure Regulator 180 could have a single reduced pressure outlet port, which would be connected to a splitter 185. A splitter 185 would have a single input port and one or more outlet ports. In this configuration, if a splitter 185 were used, there would be a single input and two outlets.

Mixing Tee 210 is preferable a Forestry Tee #5-301N from Halprin Wildfire Pacific. There is nothing inherently special about the Forestry Tee, except that it is configured with large sized adapters suitable for making connection with 1.5 inch fire hoses and other larger diameter tubes. Flow Regulator 200 is used to regulate the volume of gas that is delivered into Mixing Tee 210. Flow Regulator 200 can be as simple as a fixed orifice inline restricter or as complicated as an adjustable commercial flow regulator.

Pump 190 is typically a compressed air driven dual diaphragm pump. This enables the One-Valve CAFS 100 to be operationally independent of local electrical supplies or any type of internal combustion engine driven pump.

The input to Pump 190 is a foam concentrate water mix which is generated as follows.

Foam Concentrate 220 is stored in a Foam Concentrate Tank 230. Water 240 is stored in Water Tank 250. Though Water Tank 250 is described as a specially provided storage container, it could certainly be any pre-existing structure that could contain water, such as a swimming pool, hot tub, spa, cistern and a like structure. It could even be drawn directly from a municipal plumbing supply line. The system requires approximately 100 gallons of water for each standard sized compressed gas tank that is in the system.

Foam Concentrate Delivery Line 260, which is placed into Foam Storage Tank 230, conducts the Foam Concentrate 220 from Foam Storage Tank 230 to the first input port of Mixing Tee 270.

Water Delivery Line 280, which is placed into Water Storage Tank 250, conducts Water 240 from Water Storage Tank 250 to the second input port of Mixing Tee 270.

For optimal operation the fluid levels in Water Storage Tank 250 and Foam Concentrate Tank 230 need to be physically at the same level so that there is less chance of fluid flowing from one tank to the other through Mixing Tee 270. Intermixing of the foam concentrate and water in the storage tanks, prior to use, can reduce the effectiveness of the components.

Flow Regulator 290 is placed in-line with Foam Concentrate Delivery Line 260. Check Valve 300 is placed in-line with Water Delivery Line 280. Check Valve 300 is oriented so that water can flow from Water Tank 250, but not drain back into Water Tank 250.

Figure 2B:
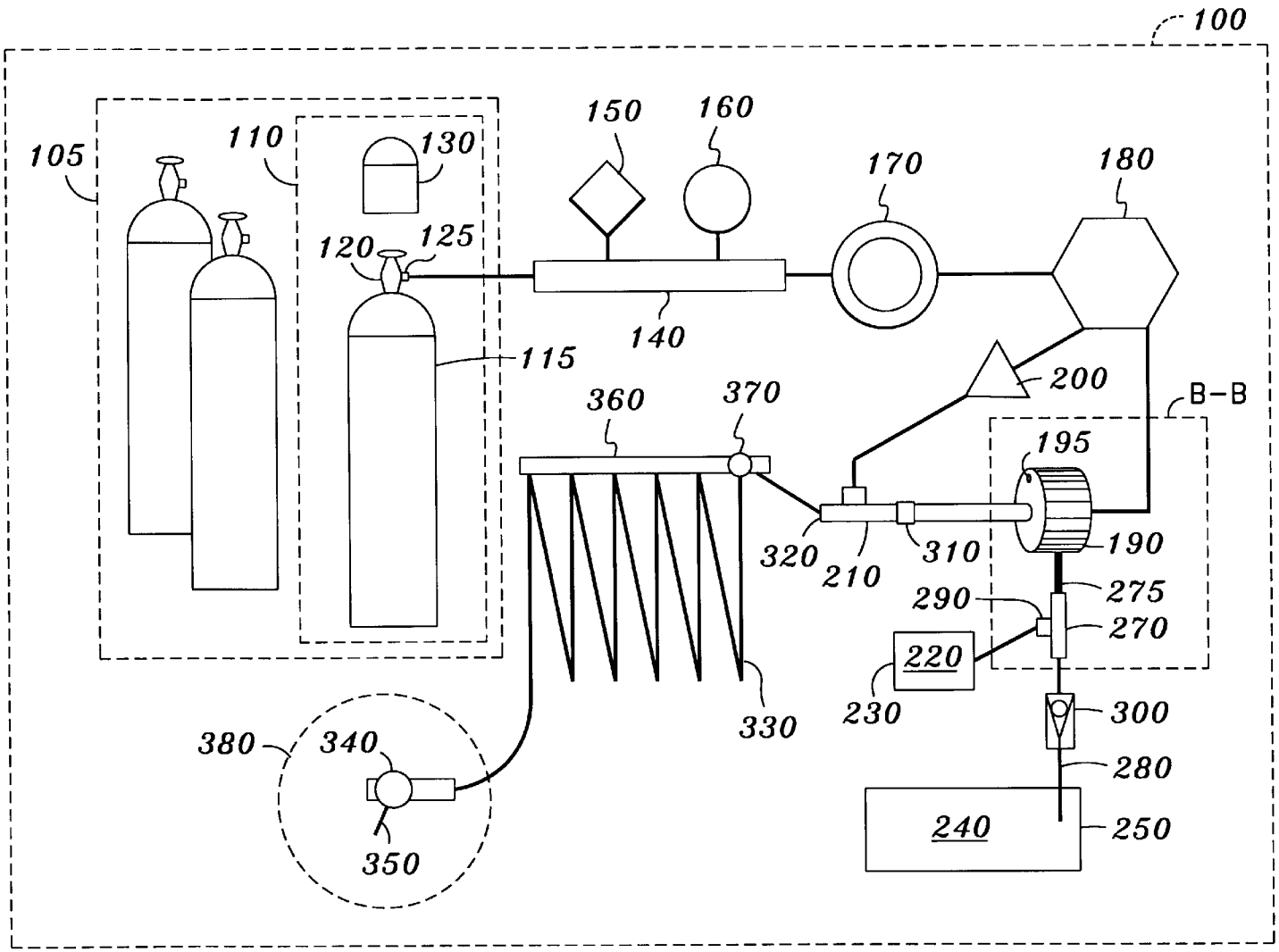
FIG. 2B. is a flow schematic for an alternative embodiment as identified at B—B.

Foam Concentrate 220 and Water 240 are combined within Mixing Tee 270 producing a Concentrate-Water Mixture, which is communicated from the output port of Mixing Tee 270 to the input of Pump 190 by means of Mixture Line 275. Mixture Line 275 may be a simple fluid connection or be enlarged, as illustrated in FIG. 2B, to allow storage of a portion of the Concentrate-Water Mixture.

The outlet port of Pump 190 is connected to Flow Limiting Orifice 310 which is connected to the second input port of Mixing Tee 210.

The introduction of the compressed gas into the Concentrate-Water Mixture inside Mixing Tee 210 initiates the generation of the Foam 320.

Foam 320 is conducted via Hose 330, which is typically a 1.5" diameter fire hose. Hose 330 is typically 100 feet in length. This length is used because there needs to be sufficient residence time in the hose for proper generation of Foam 320. In addition, 100 feet is a realistic length of hose needed in order to reach all sides of a structure and to allow the operator flexibility in positioning in order to maintain a safe distance from the fire.

The outlet end of Hose 330 fitted with a Fluid Control 380 means such as a Ball Valve 340 and a Pistol Grip 350 in order to facilitate handling by the operator. The outlet end of Hose 330 is typically just the open end of Ball Valve 340. There is no special foaming or aerating fitting needed.

Hose 330 is typically stored within Hose Rack 360, which is preferably obtained from Elkart Brass as no. #S-41-R. Pinch Valve 370 is part of Hose Rack 360. Hose Rack 360 and Pinch Valve 370 operate in the following manner. Hose 330 is stored collapsed and folded up inside Hose Rack 360. The last fold of Hose 330, that is the fold closest to Pump 190, is placed within Pinch Valve 370, which mechanically pinches the last fold of Hose 330 and prevents flow. In use, the operator, having turned on Master Valve 170, holds the outlet end of Hose 330 and pulls the Hose 330 out of the Hose Rack 360. When the last fold of Hose 330 is removed from Hose Rack 360, the last fold is also pulled out of Pinch Valve 370, thus releasing the seal on the Hose 330 which now allows Hose 330 to be fully pressurized by Foam 320 making the One-valve CAFS 100 ready for use by the operator. The use of Hose Rack 360 and Pinch Valve 370 allows Hose 330 to be fully deployed and under control before it is pressurized.

A First Alternative Embodiment

As described above, there are two reduced pressure outlet ports on Pressure Regulator 180. One port supplies gas to operate Pump 190 and the other port supplies gas to pressurize the foam concentrate/water mixture to create foam. The gas used to operate Pump 190 is exhausted to atmosphere and not used further.

A Second Alternative Embodiment

Figure 3:
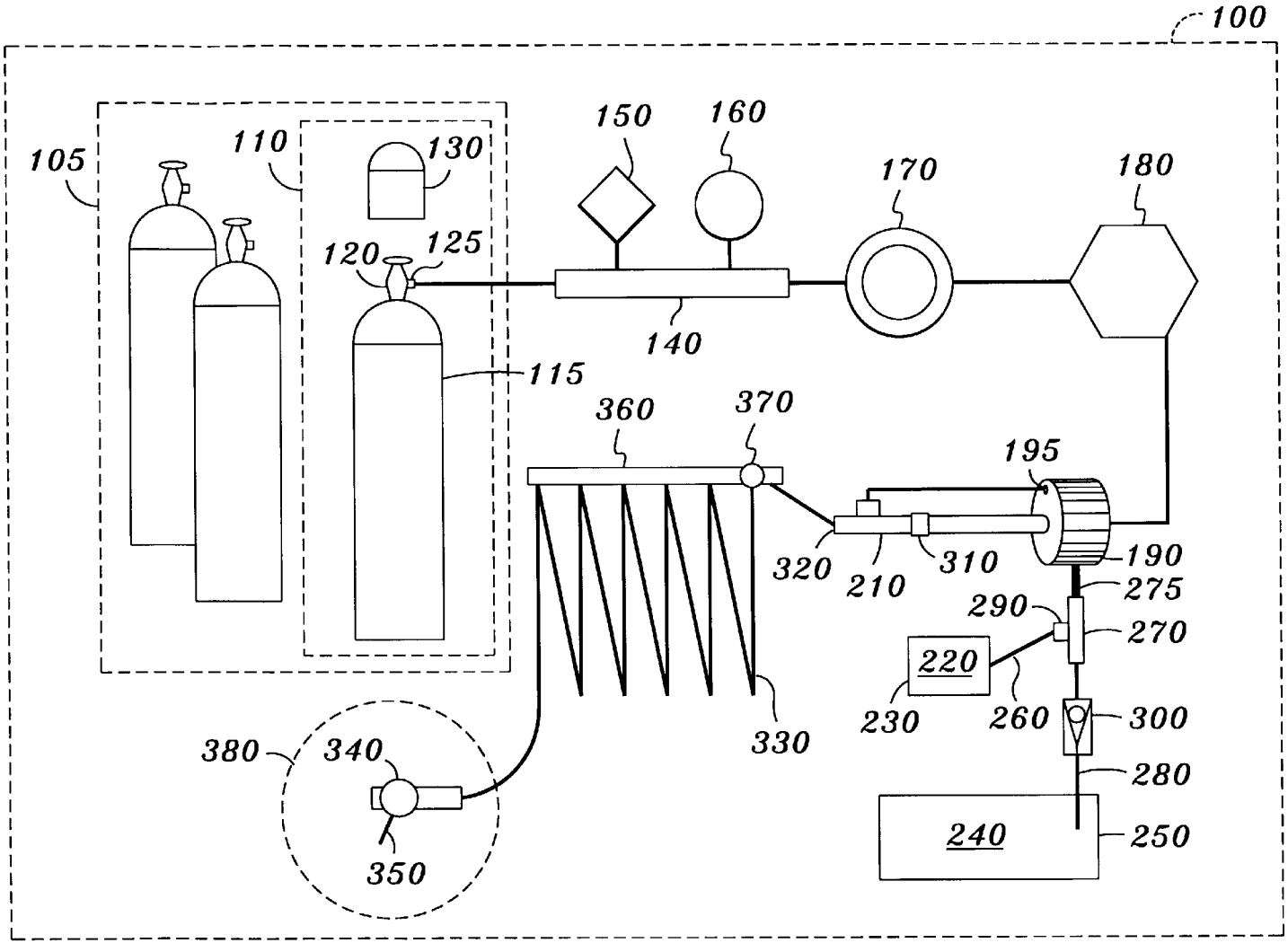
FIG. 3. is a flow schematic for an alternative embodiment in which the exhaust gas from the air-driven pump is re-circulated.

An alternative embodiment is shown in FIG. 3. In this configuration, the Exhaust Port 195 of Pump 190 is connected to the second inlet port of Mixing Tee 210. The second reduced pressure outlet port of Regulator 180 is eliminated as well as the connection needed to bring compressed gas from Regulator 180 to the second input port of Mixing Tee 210. Thus the consumption of compressed gas is reduced by approximately 50 percent.

Reference is now made to only the affected elements shown in FIG. 3. The description is the same for all elements described in FIG. 2 with the following changes to Pressure Regulator 180, Exhaust Port 195, and Mixing Tee 210.

There is only one outlet port for Pressure Regulator 180. That port is in fluid communication with the input port to Pump 190. Thus there is no direct fluid communication between Regulator 180 and Mixing Tee 210.

Mixing Tee 210 has the same configuration, but is connected differently. The first input port for Mixing Tee 210 is connected to the outlet of Pump 190. The second inlet port, which had been connected to Pressure Regulator 180 is instead connected to Exhaust Port 195 of Pump 190.

In all other aspects, this embodiment is the same as that shown and described in FIG. 2.

A Third Alternative Embodiment

An alternative embodiment is to place all of the components within a defined structure, so that only those components that the ordinary operator would need, are visible or readily accessible. This isolates such devices as regulators so that they are less likely to be inadvertently changed.

The flow path and basic functionality for this embodiment is the same as previously describe, only the physical location and placement of the components changes and thus only the physical location and placement of key component will be shown and described.

Figure 4:
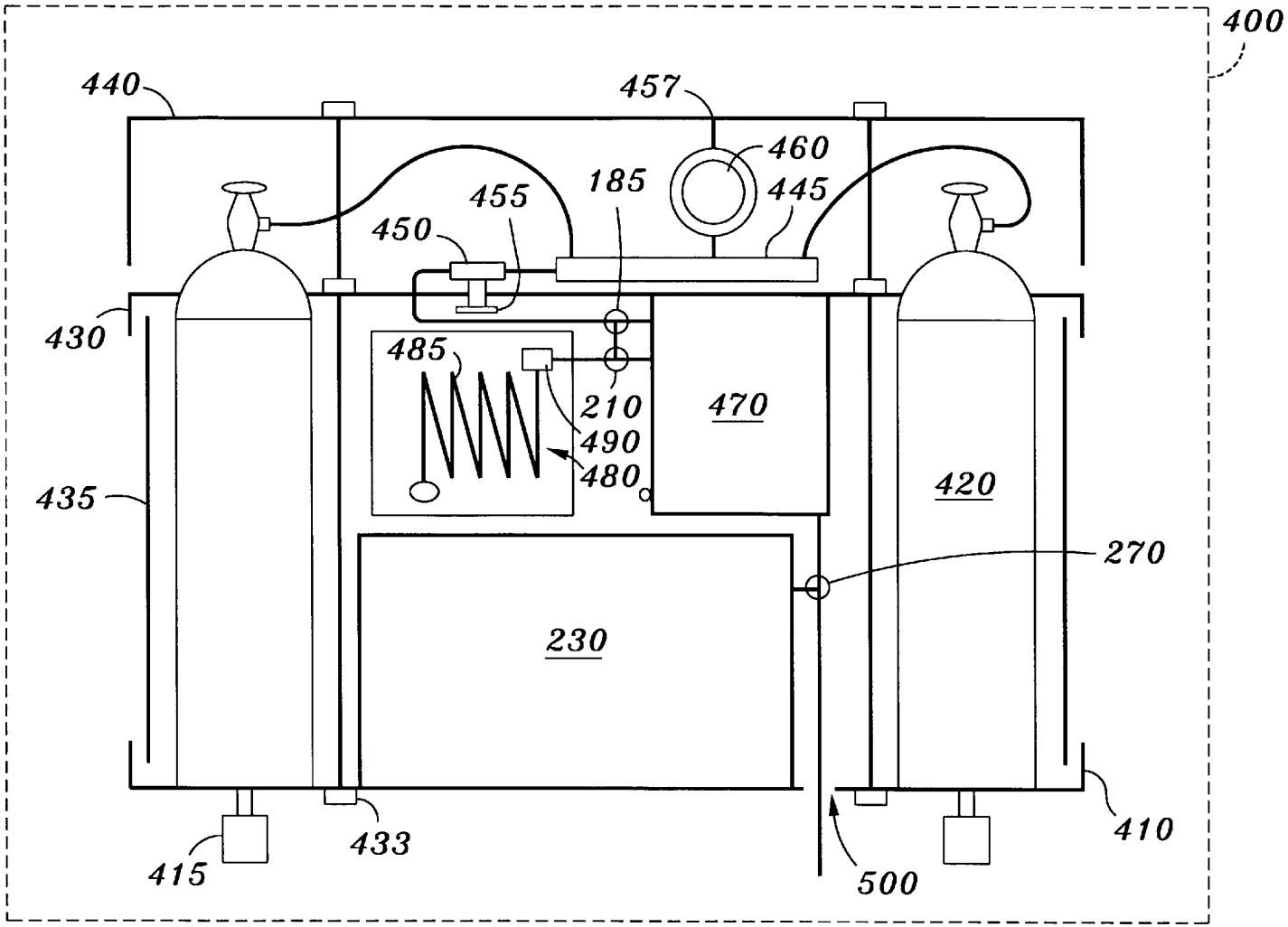
FIG. 4. Schematic for an alternative embodiment in which all components are mounted in a single enclosure.

Enclosed CAFS 400 is described in reference to FIG. 4.

The entire Enclosed CAFS 400 is supported by Lower Shelf 410 which has an upturned lip. Lower Shelf 410 may also be supported by Casters 415, which provides some mobility.

Compressed Gas Tanks 420 are placed inside Lower Shelf 410 and retained in place by Upper Shelf 430 which has a down turned lip. The Upper Shelf 430 typically has holes cut therein so as to fit part way over the upper portion of Compressed Gas Tanks 420 to help retain them in place. Upper Shelf 430 is held in place by Threaded Rods 433 running from Lower Shelf 410 through Upper Shelf 430, wedging Compressed Gas Tanks 420 between Upper Shelf 430 and Lower Shelf 410. Standard mounting hardware is attached on each end of Threaded Rods 433 to hold Lower Shelf 410 and Upper Shelf 430 together.

Panels 435 of the appropriate height are placed under the down turned lip of Upper Shelf 430 and the up turned lip of Lower Shelf 410. Thus the whole area between Upper Shelf 430 and Lower Shelf 410 can be enclosed. As a means for access, one panel can be sized slightly smaller than the maximum distance between Upper Shelf 430 and Lower Shelf 410 so that when the panel is raised until it touches the lower portion of Upper Shelf 430, the lower edge of the panel then clears the up turned lip of the Lower Shelf 410 and the access panel can be pulled out and set aside. This access panel typically has a handle affixed to the outside surface to facilitate handling and removal.

All high pressure compressed gas lines and components are located above Upper Shelf 430. Protective Lid 440 is located above Upper Shelf 430 and fits down over and mates with Upper Shelf 430, isolating all the high pressure fittings and components from the rest of the system. The valve body for Master Valve 450 is located above Upper Shelf 430. However the Actuating Handle 455 for Master Valve 450 penetrates through Upper Shelf 430 and is accessible from within the enclosed space below Upper Shelf 430.

There is a Cutout 457 in Protective Lid 440 which allows the face of High Pressure Gauge 460 to be visible from outside the enclosed space at all times. Access to High Pressure Gauge 460 is critical so that the total amount of gas, as reflected by the overall system pressure, as well as operational readiness can be quickly determined.

Typically Compressed Tanks 420 are arranged in a U-shaped pattern within Lower Shelf 410. Pump 470 is suspended below Upper Shelf 430 and within the enclosed space in the area not occupied by the Compressed Gas Tanks 420. Foam Concentrate Tank 230 rests on the upper surface of Lower Shelf 410.

Access Hole 500, located in bottom of Lower Shelf 410, provides an opening through which an inlet hose for Pump 470 can be located. This system is designed to have an external source of water which could be a municipal supply connection, a swimming pool, hot tub, cistern, spa or similar structure containing water.

Also within the space between the two shelves is Hose Rack 480, which contains Hose 485. The first end of Hose 485 is connected to Mixing Tee 210. The last fold of Hose 485 is held by Pinch Valve 490. The free end of Hose 485 may be connected to a ball valve and pistol grip for ease of operation, which are not shown.

In normal operation the steps taken by the user are listed below. These steps assume that the invention has been previously installed and adjusted.

1. Inspect the high pressure gauge, which is visible through the cut out on Protective Lid, to verify that there is sufficient compressed gas for operation.
2. Remove the access panel and set it aside.
3. Fully open the master valve which is accessible once the access panel has been removed.
4. Pull the hose out of the hose rack to a sufficient distance to remove the last fold of the Hose from the Hose Rack Pinch Valve. The hose will now become pressurized.
5. Activate the ball valve at the end of the hose and dispense foam as needed.

Note that there was no need to remove the protective lid or gain access to any of the tank valves, regulators or high pressure manifold or manually adjust any of the pressure regulators, air or water valves.

What is claimed is:

1. A one valve compressed air foam apparatus comprising:

a source of compressed gas;

a manifold having at least two ports wherein said source of compressed gas is placed in fluid communication with said manifold by way of the first of said ports;

a valve, having an inlet port and an outlet port, wherein said inlet port is placed in fluid communication with said second port of said manifold, wherein said valve controls the flow of the compressed gas from said compressed gas source to said outlet port of said valve;

a regulator place in fluid communication with said outlet port of said valve wherein flow of compressed gas is regulated;

a compressed gas driven pump having a compressed gas inlet port, a fluid inlet port and a fluid outlet port wherein said compressed gas inlet port is placed in fluid communication with said regulator by a means for communication;

a fluid storage means containing foam concentrate and water, said fluid storage means placed in fluid communication with said fluid inlet of said compressed gas driven pump;

a mixing means having two inlet ports and one outlet port, wherein the first inlet port is placed in fluid communication with said fluid outlet port of said pump and said second inlet port is placed in fluid communication with said regulator by a means for communication, whereby said mixture of foam concentrate and water is mixed with said compressed gas forming the foam and communicating the foam to said outlet port of said mixing means; and a delivery hose, having an inlet end and a delivery end, wherein said inlet end is placed in fluid communication with said outlet port of said mixing means, whereby the foam is communicated through said delivery hose and allowed to discharge from said delivery end of said delivery hose.

2. A one valve compressed air foam apparatus as set forth in claim 1 further comprising:

a third port on said manifold; and a pressure gauge in fluid communication with said third port of said manifold whereby said pressure gauge registers the pressure of said compressed gas source.

3. A one valve compressed air foam apparatus as set forth in claim 2, further comprising:

a fourth port on said manifold; and an access valve placed in fluid communication with said fourth port of said manifold whereby said access valve permits compressed gas to be introduced into said manifold for testing purposes or to regenerate said compressed gas source.

4. A one valve compressed air foam apparatus as set forth in claim 1 further comprising:

a second flow regulator placed in fluid communication between said fluid storage means and said fluid inlet port of said compressed gas driven pump wherein flow of the foam concentrate and water mixture can be regulated.

5. A one valve compressed air foam apparatus as set forth in claim 1, further comprising:

said regulator having two outlet ports as the means for communication wherein the said first outlet port is in fluid communication with said pump; and said second outlet port is in fluid communication with said mixing tee.

6. A one valve compressed air foam apparatus as set forth in claim 1, further comprising:

said regulator having an outlet port which is in fluid communication with a splitter having an inlet port and two outlet ports;

said first splitter outlet port is in fluid communication with said pump; and said second splitter output port is in fluid communication with said mixing tee.

7. A one valve compressed air foam apparatus as set forth in claim 1, further comprising:

said fluid storage means comprising a mixing tee with two input ports and one output port;

a water tank in fluid communication with said mixing tee first input port and a foam tank in fluid communication with said mixing tee second input port; and said mixing tee output port in fluid communication with said pump.

8. A one valve compressed air foam apparatus as set forth in claim 7, further comprising a mixture line for fluid communication between said mixing tee output port and said pump.

9. A method utilizing a single master control valve for the generation of compressed air foam comprising the step of:

providing a source of compressed gas;

providing a manifold having at least two ports;

placing said source of compressed gas in fluid communication with said first port of said manifold;

providing a valve having an inlet port and an outlet port;

placing said second port of said manifold in fluid communication with said inlet port of said valve;

providing a splitter means having an inlet port and two outlet ports;

placing the outlet of said valve in fluid communication with said inlet port of said splitter;

providing a compressed gas driven pump having a compressed gas inlet port, a fluid inlet port, a fluid outlet port, and a compressed gas exhaust port;

placing said first outlet port of said splitter in fluid communication with said compressed gas inlet port;

providing a fluid storage means containing therein a mixture of foam concentrate and water in an appropriate ratio;

placing said fluid storage means in fluid communication with said fluid inlet port of said compressed gas driven pump, wherein said foam concentrate water mixture is communicated to said compressed gas driven pump;

providing a mixing means having at least two inlet ports and at least one outlet port;

placing said fluid outlet port of said compressed gas driven pump in fluid communication with said first inlet port of said mixing means;

placing said second outlet port of said splitter means in fluid communication with said second inlet port of said mixing means whereby compressed gas is introduced into the foam concentrate/water mixture causing the generation of foam;

providing a delivery hose having an inlet end and a delivery end; and placing said outlet port of said mixing means in fluid communication with said inlet end of said delivery hose whereby the foam is communicated through said delivery hose and discharged from the delivery end of said delivery hose.

10. A one-valve compressed air foam apparatus comprising:

a source of compressed gas;

a manifold having at least two ports wherein said source of compressed gas is placed in fluid communication with said manifold by way of the first of said ports;

a valve, having an inlet port and an outlet port, wherein said inlet port is placed in fluid communication with said second port of said manifold, wherein said valve controls the flow of the compressed gas from said compressed gas source to said outlet port of said valve;

a compressed gas driven pump having a compressed gas inlet port, a fluid inlet port, a fluid outlet port and a compressed gas exhaust port wherein said compressed gas inlet port is placed in fluid communication with said outlet port of said valve;

a fluid storage means containing therein a mixture of foam concentrate and water in an appropriate ratio, said fluid storage means placed in fluid communication with said fluid inlet of said compressed gas driven pump;

a mixing means having two inlet ports and one outlet port, wherein the first inlet port is placed in fluid communication with said fluid outlet port of said pump and said second inlet port is placed in fluid communication with said compressed gas exhaust port of said pump, whereby said mixture of foam concentrate and water is mixed with said compressed gas forming foam and communicating the foam to said outlet port of said mixing means; and a delivery hose, having an inlet end and a delivery end, wherein said inlet end is placed in fluid communication with said outlet port of said mixing means, whereby the foam is communicated through said delivery hose and allowed to discharge from said delivery end of said delivery hose.

11. A one valve compressed air foam apparatus comprising:

an enclosure having a separating panel dividing said enclosure into an upper compartment and a lower compartment and an access panel providing access to the interior of said lower compartment for the purpose of installation and maintenance;

a source of compressed gas having a storage portion located in said lower compartment and a valve portion located in said upper compartment;

a manifold having at least two ports located in said upper compartment wherein said valve portion is placed in fluid communication with said manifold section by way of the first of said manifold ports;

a valve, having an inlet port and an outlet port located in said upper compartment and a control handle located in said lower compartment, wherein said inlet port is placed in fluid communication with said second port of said manifold, wherein said valve controls the flow of the compressed gas from said compressed gas source to said outlet port of said valve;

a splitter means located in said lower compartment having an inlet port and two outlet ports, wherein said inlet port is placed in fluid communication with said outlet port of said valve by penetrating said separating panel;

a compressed gas driven pump located in said lower compartment having a compressed gas inlet port, a fluid inlet port and a fluid outlet port wherein said compressed gas inlet port is placed in fluid communication with said first of said outlet ports of said splitter means;

a mixing tee located in said lower compartment having two inlet ports and one outlet port, said outlet in fluid communication mixing tee with said fluid inlet port of said pump;

a fluid storage means located in said lower compartment, containing therein foam concentrate, said fluid storage means placed in fluid communication with one of said inlet ports of said mixing tee;

a water delivery hose, having a first end and a second end, said first end placed in fluid communication with said second inlet port of said mixing tee and said second end placed into an assessable storage container of water;

a mixing means located in said lower compartment having two inlet ports and one outlet port, wherein the first inlet port is placed in fluid communication with said fluid outlet port of said pump and said second inlet port is placed in fluid communication with said second outlet port of said splitter means, whereby said mixture of foam concentrate and water is mixed with said compressed gas forming the foam and communicating the foam to said outlet port of said mixing means; and a delivery hose, located in said lower compartment, having an inlet end and a delivery end, wherein said inlet end is placed in fluid communication with said outlet port of said mixing means, whereby the foam is communicated through said delivery hose and allowed to discharge from said delivery end of said delivery hose.

* * * * *